US009570790B2

(12) United States Patent
Nagel et al.

(10) Patent No.: US 9,570,790 B2
(45) Date of Patent: Feb. 14, 2017

(54) TRANSMISSION LINE AND CONNECTOR, WHERE THE TRANSMISSION LINE INCLUDES HOLDING PINS EXTENDING THROUGH AN INNER CONDUCTOR

(71) Applicant: SPINNER GmbH, München (DE)

(72) Inventors: Reimer Nagel, Hannover (DE); Martin Graβl, Langenbach (DE); Wolfgang Ziβler, Feldkirchen Westerham (DE); Robert Niebauer, Bad Feilnbach (DE); Alexander Winkelmann, Thiersee (AT)

(73) Assignee: SPINNER GMBH, München (DE)

( * ) Notice: Subject to any disclaimer, the term of this patent is extended or adjusted under 35 U.S.C. 154(b) by 0 days.

(21) Appl. No.: 14/547,468

(22) Filed: Nov. 19, 2014

(65) Prior Publication Data

US 2015/0137912 A1 May 21, 2015

(30) Foreign Application Priority Data

Nov. 21, 2013 (EP) ..... 13193874

(51) Int. Cl.

| | |
|---|---|
| ***H01P 5/08*** | (2006.01) |
| ***H01P 3/02*** | (2006.01) |
| ***H01P 1/02*** | (2006.01) |
| ***H01P 1/04*** | (2006.01) |
| ***H01P 3/06*** | (2006.01) |
| ***H01R 24/50*** | (2011.01) |

(Continued)

(52) U.S. Cl.

CPC ..... *H01P 5/085* (2013.01); *H01P 1/02* (2013.01); *H01P 1/045* (2013.01); *H01P 3/02* (2013.01); *H01P 3/06* (2013.01); *H01R 24/50* (2013.01); *H01R 12/53* (2013.01); *H01R 2103/00* (2013.01)

(58) Field of Classification Search

CPC ..... H01P 1/02; H01P 1/04; H01P 1/045; H01P 3/06; H01P 5/085

USPC ..... 333/244, 245, 243, 260, 33

See application file for complete search history.

(56) References Cited

U.S. PATENT DOCUMENTS 2,251,530 A * 8/1941 Thorne ..... H01B 11/1834 174/19

2,504,104 A * 4/1950 Arnold, Jr. ..... H01P 1/02 174/21 CA (Continued)

FOREIGN PATENT DOCUMENTS

| | | |
|---|---|---|
| EP | 1 191 642 | 3/2002 |
| EP | 1 939 974 | 8/2008 |
| FR | 2 629 275 | 9/1989 |

*Primary Examiner* — Benny Lee

(74) *Attorney, Agent, or Firm* — Norton Rose Fulbright US LLP

(57) ABSTRACT

A RF connector assembly, suitable for millimeter waves comprises a housing, holding a transmission line and a RF connector. The transmission line has a band conductor held in an outer conductor. The band conductor is supported by a plurality of holding pins. The holding pins are fixed by holes in the outer conductor and penetrate the inner conductor through holes therein. The holding pins are injection molded parts made of plastic. They comprise of two sections which can be connected together by a plug and socket connection. One end of the transmission line has a printed circuit board contact for contacting a strip line, while the other end of the transmission line has a contact for connecting the inner conductor of the RF connector.

17 Claims, 5 Drawing Sheets

(51) Int. Cl.
*H01R 103/00* (2006.01)
*H01R 12/53* (2011.01)

(56) References Cited

U.S. PATENT DOCUMENTS

| | | | | | |
|---|---|---|---|---|---|
| 2,796,589 | A * | 6/1957 | Adams | H01B 11/1873 | 174/28 |
| 3,344,370 | A * | 9/1967 | Sewell | H01B 11/1873 | 174/28 |
| 3,560,896 | A | 2/1971 | Essinger | 333/243 | |
| 3,825,861 | A | 7/1974 | O'Donnell | 333/33 | |
| 3,943,470 | A * | 3/1976 | Bingham | H01R 9/0521 | 333/260 |
| 4,019,162 | A * | 4/1977 | Banning | H01B 11/1834 | 333/244 |
| 4,365,222 | A | 12/1982 | Lampert | 333/238 | |
| 4,669,805 | A | 6/1987 | Kosugi et al. | 439/581 | |
| 4,995,815 | A * | 2/1991 | Buchanan | H01R 9/0515 | 333/260 |
| 6,466,112 | B1 * | 10/2002 | Kwon | H01L 23/5225 | 333/238 |
| 2004/0038587 | A1 * | 2/2004 | Yeung | H01P 5/085 | 439/581 |

* cited by examiner

TRANSMISSION LINE AND CONNECTOR, WHERE THE TRANSMISSION LINE INCLUDES HOLDING PINS EXTENDING THROUGH AN INNER CONDUCTOR

PRIORITY CLAIM

This application claims priority to pending European Application No. 13193874.8 filed on Nov. 21, 2013, which is incorporated by reference in its entirety.

BACKGROUND OF THE INVENTION

1. Field of the Invention

The invention relates to an RF connector assembly which may be used for millimeter waves and which can be mounted to a printed circuit board. A further aspect of the invention is a transmission line, which may be used to connect an RF connector to a printed circuit board. The transmission line is based on a band conductor.

2. Description of Relevant Art

A RF connector assembly is disclosed in U.S. Pat. No. 6,607,400 B1. A connector is mounted into a cutout of a printed circuit board. The electrical contact is established by soldering pads to a ground plane and to a signal line. Due to their design, such connectors are only suitable for frequencies up to order of magnitude of 1 GHz.

A millimeter wave connector for interconnecting a microstrip circuit and an external circuit is disclosed in U.S. Pat. No. 4,669,805. The connector is held in a housing, which also contains a microstrip substrate to be connected to the connector. During assembly, the flexible center conductor of the connector has to be bent to adapt to the microstrip circuit. Bending of the center conductor may cause asymmetries, which degrade the electrical characteristics of the connector.

U.S. Pat. No. 5,797,765 discloses a coaxial connector for mounting on a circuit substrate. The connector is soldered under a right angle to the surface of a substrate. For contacting the center conductor, a bond wire is used. Therefore, assembly of this connector requires complex special machines for bonding.

SUMMARY OF THE INVENTION

The embodiments are based on the object of providing a millimeter wave connector, which can be mounted to a printed circuit board or any other microstrip substrate without requiring complex and expensive mounting tools. Furthermore, it is desirable to have a connector, which can be mounted to the edge or any other location of a printed circuit board and which may be mounted essentially parallel or under any other angle to the printed circuit board. Another problem to be solved is to provide a transmission line with a band conductor, which may be used to connect such a connector to a printed circuit board.

In an embodiment, a transmission line is held by a housing and preferably integrated into the housing. There is an outer conductor which may be formed by the housing, or which may be a metal tube, preferably a tube having a rectangular, squared, or round cross-section. Within the outer conductor, an inner conductor is provided. The inner conductor preferably comprises metal band and preferably has a rectangular cross-section. The outer conductor has a straight form, but may also be bent or curved to any other form. The inner conductor is held by a plurality of holding pins at a specific position, preferably centered within the outer conductor. The inner conductor preferably follows the bending or curve of the outer conductor. The holding pins are held by holes in the outer conductor and penetrate the inner conductor through holes in the inner conductor. The holes may be round or elongated holes, which may tolerate some movement of the inner conductor. It is preferred, if the holding pins comprise a first pin section and a second pin section. Preferably, each pin section has a pin head and a pin shaft. A first pin shaft and a second pin shaft preferably are formed such that they can be connected together. The first pin shaft and second pin shaft, respectively, may have a plug (male) component and a socket (female) component. Preferably, at the center of the pin a gap is formed which interfaces with a hole of the inner conductor and holes the inner conductor at a predetermined position. Due to the holding pins, the inner conductor follows the shape or curve of the outer conductor. The inner conductor is perfectly centered within the outer conductor. Therefore, the present transmission line has excellent properties in the millimeter wave range (like frequencies up to 110 GHz).

The inner conductor and the outer conductor preferably are made of a metal, like aluminum, brass, copper, or any other suitable material, or any alloy thereof. It is further preferred to have the inner conductor of a material, which has elastic or spring-elastic properties. It is further preferred, if at least one of the outer conductor and inner conductor have a coating of a high-conductive and low-corrosive material or metal, like silver or gold.

Preferably, the holding pins are made of an insulating material, like plastic material. Most preferably, the holding pins are manufactured by injection molding. It is further preferred, if the holding pins are directly injection molded to the inner connector.

In another embodiment, a millimeter wave connector for printed circuit boards comprises a housing, an RF connector, and a transmission line for connecting the RF connector preferably to a printed circuit board.

The transmission line preferably has a first end with a printed circuit board contact. This printed circuit board contact preferably is a tapered section of the inner conductor, which may be pressed against a strip line of a printed circuit board. The transmission line may have a second end for contacting the RF connector for connecting the center conductor of the RF connector. Preferably, second end of the transmission line is mounted in such a spatial relation to the RF connector that second end of the transmission line asserts a light force due to its spring-elastic property against the center conductor of the RF connector, therefore achieving a proper electrical contact. It is preferred, if the RF connector is a standard RF connector. It is further preferred to hold a flange type RF connector within the housing. Although the transmission line is disclosed herein with a preferred embodiment having means for connecting to a printed circuit board and a RF connector, the transmission line is not limited to this application. It may be a general transmission line being suitable for any purpose a transmission line can be used. It is further preferred, if the transmission line is a semi rigid transmission line. If the outer conductor is bent, the inner conductor of the following this bending and therefore maintain the good transmission line properties.

In a further embodiment, a connector assembly has a housing which holds a transmission line and two coaxial line connectors. Each end of the transmission line is connected to one of the coaxial line connectors. The coaxial line connectors may be flanges holding a coaxial line. It is further preferred, if at least one of the coaxial line connectors holds a center conductor having a slotted end for contacting the inner conductor. The inner conductor may be slidable in the slot to compensate for length changes of the center conductors which may be caused by thermal expansion. The inner conductor may be straight, but preferably, the inner conductor is arc shaped and the two coaxial line connectors are mounted under an angle to the housing, whereas the angle preferably is in the range between 60° and 120°, most preferably 90°. Such a connector assembly may be in the form of an elbow.

BRIEF DESCRIPTION OF THE DRAWINGS

In the following, the invention will be described by way of example, without limitation of the general inventive concept, on examples of embodiment and with reference to the drawings.

Figure 1:
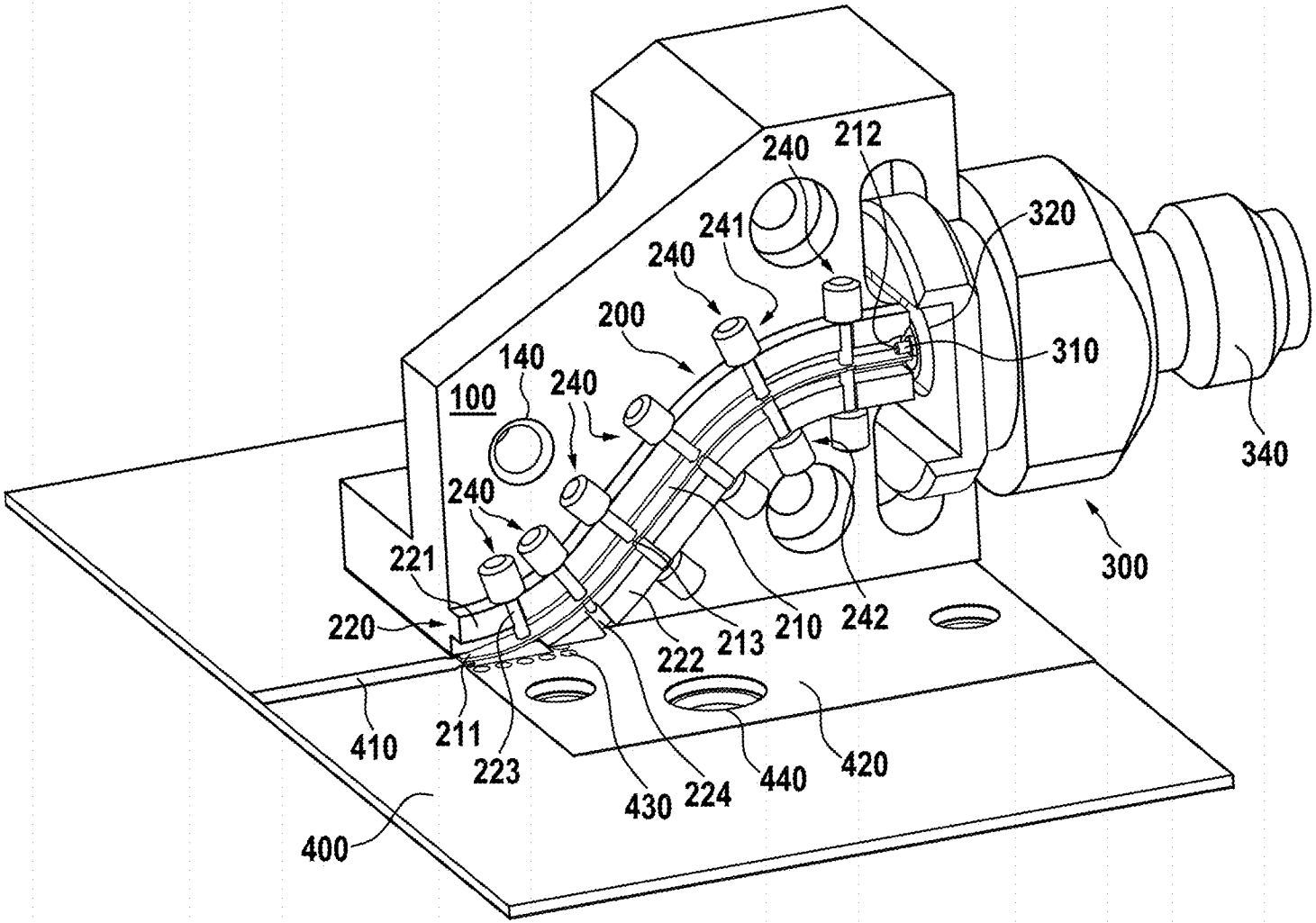
FIG. 1 shows a perspective view of the RF connector assembly.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

FIG. 1 shows a perspective view of the RF connector assembly.

Figure 2:
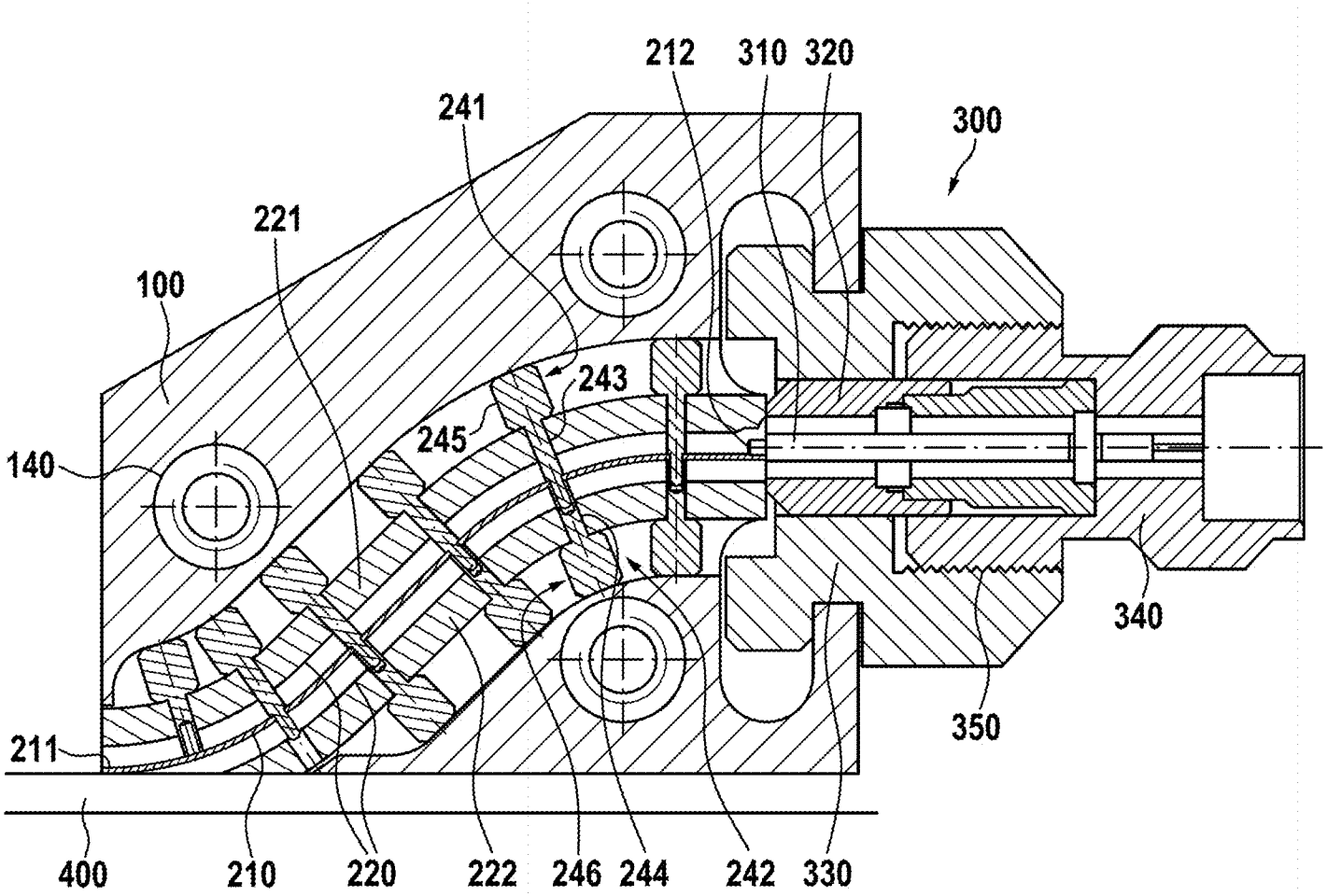
FIG. 2 shows a sectional view of the RF connector assembly.

FIG. 2 shows a sectional view of the RF connector assembly.

Figure 3:
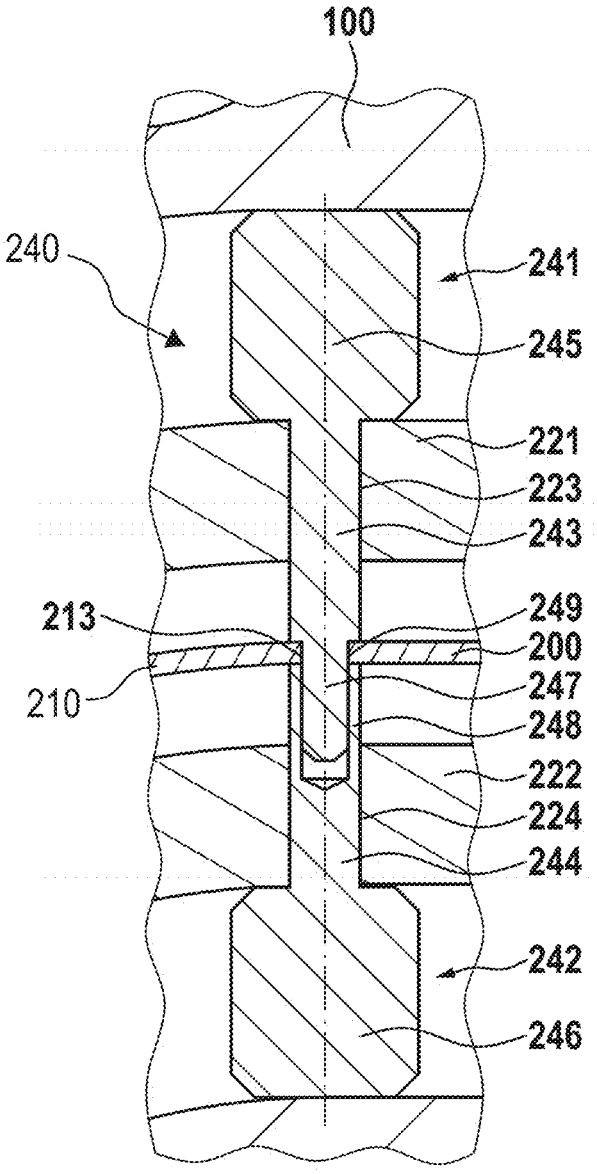
FIG. 3 shows an enlarged sectional view of a holding pin holding the inner conductor of the transmission line.

FIG. 3 shows an enlarged sectional view of a holding pin holding the inner conductor of the transmission line.

Figure 4A:
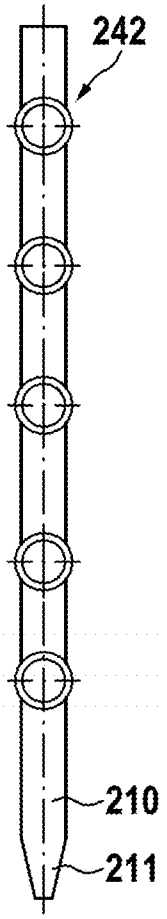
FIGS. 4A and 4B, respectively, show top and side views of a band conductor.
Figure 4B:
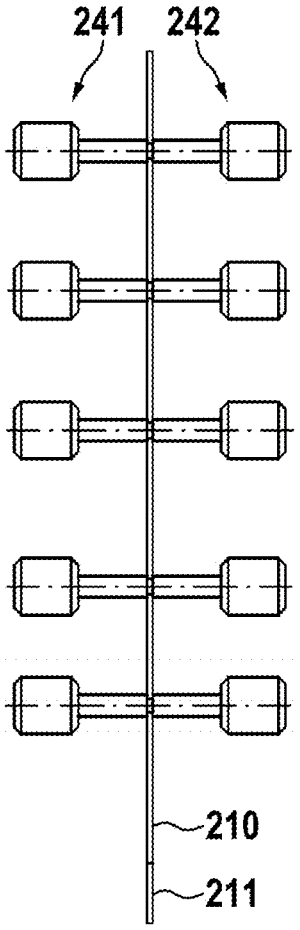

FIGS. 4A and 4B, respectively, show top and side views of a band conductor.

Figure 5:
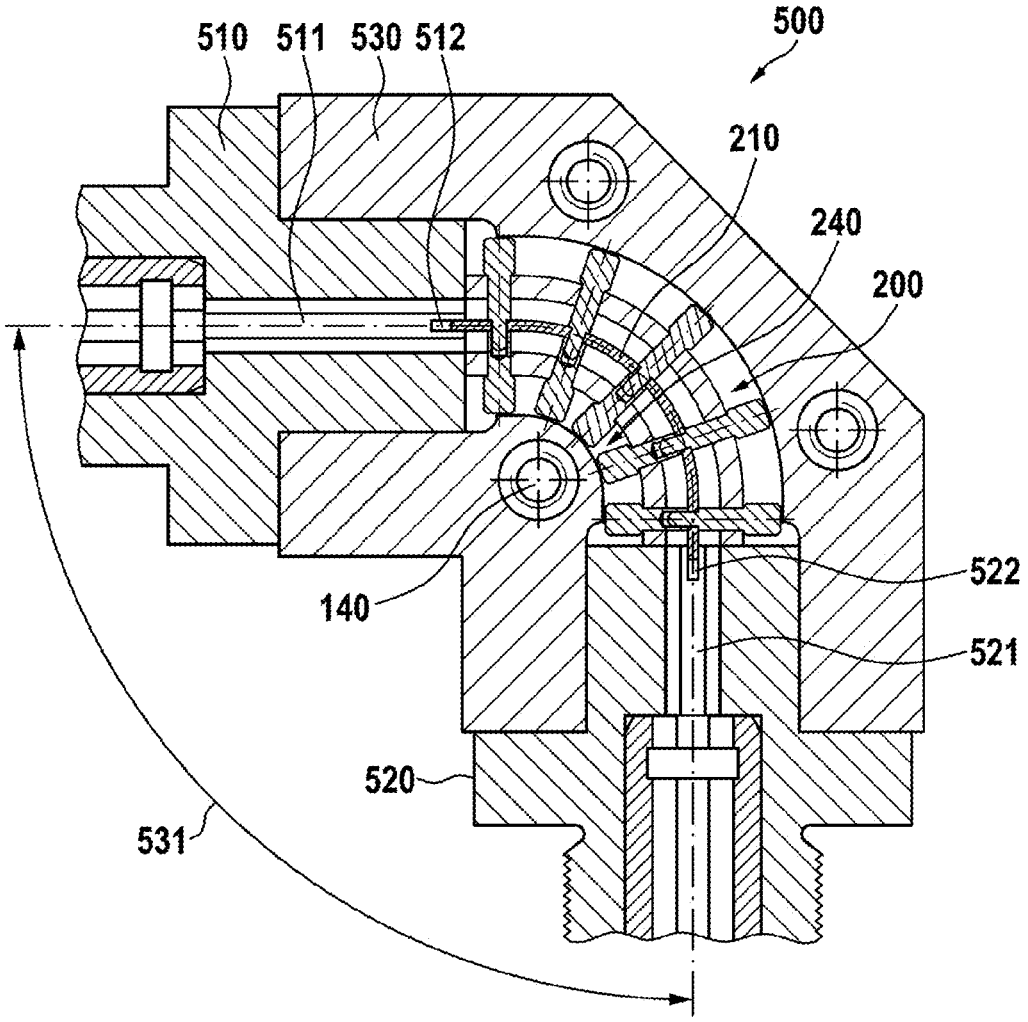
FIG. 5 shows a further embodiment.

FIG. 5 shows a further embodiment.

In FIG. 1, a preferred embodiment is shown. A millimeter wave connector for printed circuit boards comprises a housing 100, the housing holding a transmission line 200 and an RF connector 300. Here, the housing is mounted to a printed circuit board 400, which is not part of the invention. The printed circuit board 400 has at least one strip line 410 and at least one ground plane 420. There may be through-holes 430 for connecting a ground plane on the top side to a ground plane on another layer of the printed circuit board. Furthermore, there are mounting holes 440 provided in the printed circuit board. For connecting the strip line 410 and the ground plane 420 of the printed circuit board to the RF connector 300, the transmission line 200 is provided. The transmission line 200 has an inner conductor 210 and an outer conductor 220. The inner conductor is held at a center position within the outer conductor by holding pins 240. In this embodiment, four complete and one half holding pins are shown. Each holding pin 240 has a first pin section 241 and a second pin section 242. The first pin section 241 preferably is mounted to the first side 221 of the outer conductor, while the second pin section 242 is mounted to the second side 222 of the outer conductor. The second side 222 of the outer conductor is opposing the first side 221 of the outer conductor herein. The first pin section 241 has a first pin shaft 243 (FIG. 2) and a first pin head 245 (FIG. 2). The second pin section 242 has a second pin shaft 244 (FIG. 2) and a second pin head 246 (FIG. 2). Here, the first pin shaft 243 of the first pin section 241 is held by the hole 223 in the first side of the outer conductor, while the second pin shaft 244 of the second pin section 242 is held in the hole 224 of the second side of the outer conductor. The hole 223 may also be a slot. Both pin sections are mated together and fit into a hole 213 of the inner conductor 210.

The transmission line has a first end with a printed circuit board contact 211. This is preferably a tapered end, which is preferably spring-loaded due to the spring properties of the transmission line to press against the strip line 410 of the printed circuit board 400 and establish an electrical contact.

Furthermore, the transmission line has a second end preferably having a connector contact 212, which is preferably designed to press by spring forces against the inner conductor 310 of the RF connector 300. Furthermore, it is preferred to have a two part connector comprising a connector housing 330 (FIG. 2) and a connector center part 340 which are connected by a thread 350 (FIG. 2). When the connector center part 340 is rotated against the connector housing 330 to lock the connector, the outer conductor 320 of the RF connector together with the inner conductor 310 of the RF connector are moved against the outer conductor 220 of the transmission line and the inner conductor 210 of the transmission line to establish a good electrical contact. In an alternate embodiment, a press fit of the RF connector 300 within housing 100, to press the outer conductor 320 of the RF connector 300 against the outer conductor 220 of the transmission line may be provided. At the printed circuit board side, the outer conductor 220 of the transmission line 200 is pressed against a ground plane 420 of the printed circuit board, to establish an electrical contact.

The section of the housing 100 shown herein preferably is a half housing, which is complemented by a second half housing, preferably approximately symmetrical to the first one. The housing sections may be connected by screws through clamping holes 140.

In general, the transmission line may be used alone without the RF connector 300 and the printed circuit board contact 211.

FIG. 2 shows a sectional view of the millimeter wave connector for printed circuit boards in a slightly modified embodiment. Here, the transmission line can be seen in more details, although the reference numerals previously described remain the same.

In FIG. 3, a detail of a holding pin 240 holding an inner conductor 210 is shown, and in which the reference numerals previously described remain the same. Each holding pin 240 comprises of a first pin section 241 and a second pin section 242 mated together. The first pin section 241 has a first pin head 245 and a pin shaft 243, whereas the second pin section 242 has a second pin head 246 and a pin shaft 244. Preferably, the pin shafts have means for connecting with each other, like a plug component 247 in the first pin shaft 243, and a socket component 248 in the second pin shaft 244. In this embodiment, the pin shaft 243 penetrates through a hole 213 of the inner conductor 210. Together with the second pin shaft 244, the first pin shaft 243 forms a recess 249 for precisely locating the inner conductor 210.

FIGS. 4A and 4B show a top view and a side view, respectively, of a band conductor with attached holding pins, in which the reference numerals previously described remain the same.

FIG. 5 shows a further connector assembly in the form of an elbow 500, having a housing 530 which holds a transmission line 200 and two coaxial line connectors 510, 520, and in which the reference numerals previously described remain the same. Each end of the transmission line 200 is connected to one of the coaxial line connectors 510, 520. The coaxial line connectors 510, 520 may be flanges holding a coaxial line. It is further preferred, if at least one of the coaxial line connectors 510, 520 holds a center conductor 511, 521 having a slotted end 512, 522 for contacting the inner conductor 210. The inner conductor may be slidable in the slot to compensate for length changes of the center conductors which may be caused by thermal expansion. Preferably, the inner conductor 210 is arc shaped and the two coaxial line connectors 510, 520 are mounted under an angle 531 to the housing 530, whereas the angle 531 preferably is in the range between 60° and 120°, most preferably 90°.

It will be appreciated to those skilled in the art having the benefit of this disclosure that this invention is believed to provide a millimeter wave connector and a band conductor. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

The invention claimed is:

1. Transmission line for coupling of RF signals, the transmission line comprising:

at least one outer conductor; and an inner conductor comprising a band conductor having a rectangular cross-section and comprising conductive material, wherein the inner conductor is held by a plurality of holding pins at predetermined positions within the outer conductor, the holding pins comprising an insulating material, wherein each holding pin extends through at least one hole in the outer conductor and through a corresponding hole in the inner conductor, and wherein at least one of the plurality of holding pins comprises a respective first pin section with a first pin shaft and a first pin head, and a corresponding second pin section with a second pin shaft and a second pin head.

2. The transmission line according to claim 1, wherein the at least one of the plurality of holding pins forms a recess that interfaces with the corresponding hole of the inner conductor to hold the inner conductor at a predetermined position within the outer conductor.

3. The transmission line according to claim 1, wherein the at least one of the plurality of holding pins comprises a plastic material and is injection molded.

4. The transmission line according to claim 1, wherein the first pin shaft of the respective first pin section has a plug component and the second pin shaft of the corresponding second pin section has a socket component.

5. RF connector assembly comprising a housing, an RF connector held by the housing, and a transmission line for communication of RF signals, the transmission line comprising:

at least one outer conductor; and an inner conductor comprising a band conductor having a rectangular cross-section and comprising conductive material, wherein the inner conductor is held by a plurality of holding pins at predetermined positions within the outer conductor, the plurality of holding pins comprising an insulating material, wherein the transmission line is at least partially contained in the housing for connecting with the RF connector, and wherein at least one of the plurality of holding pins comprise a respective first pin section with a first pin shaft and a first pin head, and a corresponding second pin section with a second pin shaft and a second pin head.

6. The RF connector assembly according to claim 5, wherein the first pin shaft of the respective first pin section has a plug component and the second pin shaft of the corresponding second pin section has a socket component.

7. The RF connector assembly according to claim 5, wherein the at least one of the plurality of holding pins forms a recess that interfaces with a corresponding hole of the inner conductor to hold the inner conductor at a predetermined position within the outer conductor.

8. The RF connector assembly according to claim 5, wherein the inner conductor has at one end thereof a printed circuit board contact for contacting a strip line on a printed circuit board.

9. The RF connector assembly according to claim 5, wherein the inner conductor has at least one end thereof a connector contact for contacting a center conductor of the RF connector.

10. The RF connector assembly according to claim 5, wherein the at least one of the plurality of holding pins is made of a plastic material and is injection molded.

11. RF connector assembly comprising a housing, two coaxial line connectors held by the housing, and a transmission line for coupling of RF signals, the transmission line comprising:

at least one outer conductor; and an inner conductor comprising a band conductor having a rectangular cross-section and comprising conductive material, wherein the inner conductor is held by a plurality of holding pins at predetermined positions within the outer conductor;

wherein the transmission line is at least partially contained in the housing for connecting with the coaxial line connectors, and wherein at least one of the plurality of holding pins comprises a first pin section with a respective first pin shaft and a first pin head, and a corresponding second pin section with a second pin shaft and a second pin head.

12. The RF connector assembly according to claim 11, wherein the at least one of the plurality of holding pins forms a recess that interfaces with a hole of the inner conductor to hold the inner conductor at a predetermined position within the outer conductor.

13. The RF connector assembly according to claim 11, wherein the at least one of the plurality of holding pins is made of a plastic material and is injection molded.

14. The RF connector assembly according to claim 11, wherein the inner conductor is arc shaped and the two coaxial line connectors are mounted at an angle relative to the housing.

15. The RF connector assembly according to claim 14, wherein the angle is 90 degrees.

16. The RF connector assembly according to claim 11, wherein at least one of the two coaxial line connectors holds a respective center conductor having a slotted end for contacting the inner conductor.

17. The RF connector assembly according to claim 11, wherein the first pin shaft of the respective first pin section has a plug component and the second pin shaft of the corresponding second pin section has a socket component.

* * * * *